United States Patent [19]

Leeker et al.

[11] 4,195,573

[45] Apr. 1, 1980

[54] SUB-CALIBER PROJECTILE OF ARROW-SHAPED FORM HAVING A RESISTANCE-STABILIZING TAIL SECTION

[75] Inventors: Jürgen Leeker, Neuss; Hanjörg Becker, Duesseldorf; Rudolf Rombach, Monchen-Gladbach, all of Fed. Rep. of Germany

[73] Assignee: Rheinmetall GmbH, Duesseldorf, Fed. Rep. of Germany

[21] Appl. No.: 879,507

[22] Filed: Feb. 21, 1978

[30] Foreign Application Priority Data

Oct. 21, 1977 [DE] Fed. Rep. of Germany ..... 2747313

[51] Int. Cl.[2] ..... F42B 13/32; F42B 13/16

[52] U.S. Cl. ..... 102/92.7; 102/93; 102/DIG. 10

[58] Field of Search ..... 244/3.1, 3.23, 3.24, 244/3.3; 102/92.7, 93, DIG. 10

[56] References Cited

U.S. PATENT DOCUMENTS

| | | | |
|---|---|---|---|
| 1,794,141 | 2/1931 | Bloch-Jorgensen | 244/3.23 |
| 2,145,508 | 1/1939 | Denoix | 244/3.23 |
| 3,179,052 | 4/1965 | Jasse | 244/3.24 |
| 3,620,167 | 11/1971 | Romer et al. | 102/93 |
| 3,745,926 | 7/1973 | Mertz | 102/93 |

FOREIGN PATENT DOCUMENTS

| | | | |
|---|---|---|---|
| 844987 | 5/1939 | France | 102/DIG. 10 |

*Primary Examiner*—Verlin R. Pendegrass

[57] ABSTRACT

A limited range, supersonic, sub-caliber projectile having a main body and a resistance-stabilizing tail section. This tail section has at least two bores through which air passes during flight of the projectile. The axes of the bores may be parallel or inclined relative to the longitudinal axis of the main body of the projectile.

8 Claims, 3 Drawing Figures

SUB-CALIBER PROJECTILE OF ARROW-SHAPED FORM HAVING A RESISTANCE-STABILIZING TAIL SECTION

BACKGROUND OF THE INVENTION

The present invention relates to a sub-caliber arrow-shaped projectile with a tail section having a resistance-stabilizing effect. The tail section of the projectile of the invention has a larger exterior diameter than the projectile proper.

Projectiles of this type having a conical tail section or base form part of the state of the art, for example, described in U.S. Pat. No. 3,745,926. The arrow-shape of such projectiles provides a sufficiently strong stabilization effect by virtue of the fact that the tail section of the projectile, due to its larger coefficient of resistance relative to the remainder of the projectile, effects a sufficient reorientation into the flight direction of the projectile when the proper flight conditions prevail during its flight. Such a resistance-stabilized projectile does not require, in contradistinction to a wing-stabilized projectile, any type of deflection for purposes of imparting the restoring moment to the projectile. However, the enlarged diameter of the conical tail section must not exceed 40% relative to the cross-sectional diameter of the columnar main body of the projectile because otherwise the resistance increase of the conical tail section becomes so influential that it causes an excess braking of the flight of the projectile. This in turn may cause an insufficient projectile stabilization. The afore-mentioned type of arrow-shaped sub-caliber projectiles are particularly suitable and designed for combatting armored targets. Such projectiles are required to have a high initial speed, a high flight velocity and as low as possible air resistance coefficients. Testing of such projectiles for development or for training has to be carrier out on test ranges of limited size. This is made difficult because the range of such projectiles is considerable. Of course, safety considerations are of extreme importance in these tests. When using only small barrel elevations in a flat flight path, ricochets may cover large distances which may extend beyond the test range. This is also true when a "miss" is unintentionally fired.

SUMMARY OF THE INVENTION

It is a general object of this invention to provide an arrow-shaped projectile of the afore-described type which has a limited range. The projectile of the invention is provided with a resistance-producing tail section which has sufficient stabilization characteristics. The tail section of the projectile of the invention has a substantially larger diameter than the diameter of the columnar main body of the projectile. Thus, the diameter of the tail section of the projectile of this invention is proportionally larger than the diameter of the arrow-shaped projectiles of the state of the art. The resistance of the tail section, during flight in the higher Mach number range is, however, not higher than the resistance of a comparable projectile with a conical tail section or base, wherein the diameter of the tail section or base is smaller relative to the columnar main body of the projectile as is the case with the projectile of this invention.

It is a further object of this invention to provide an arrow-shaped projectile wherein the stabilization resistance causing tail section is so constructed that the coefficient of resistance curve in the range of the lower Mach numbers approximates the high resistance coefficient of a conically shaped tail section of a large diameter and thereby provides for a firing range limit of the projectile.

Furthermore, it is an object of this invention to provide an arrow-shaped projectile of the afore-described type which is of simple construction and therefore is relatively inexpensive to manufacture.

The advantages of the sub-caliber arrow-shaped projectile of this invention can be attributed to the fact that the tail section or base of the projectile is constructed so that it has a substantially larger diameter than the diameter of the columnar body of the projectile. The tail section is provided with bores which insure that the resistance of the tail section does not increase at the same rate than the resistance of the main columnar body portion of the projectile. During flight in the high Mach number range the air can flow through the bores of the tail section of the projectile with minimal throttling or choking so that the projectile of the invention behaves in this velocity range in a manner similar to that of a projectile having a conically shaped tail section the diameter of which only slightly exceeds the diameter of the main columnar body portion of such a projectile. When, however, the velocity of the projectile decreases during flight into the lower Mach number range, then there occurs a remarkable increase in resistance which approximates that of a projectile having a tail section with no bores or passages. Thus, in the lower Mach number range the behavior of the projectile of the invention is such that its resistance may be compared to a projectile with a conically shaped tail section having practically the largest diameter so that a very rapid deceleration of the projectile occurs to thereby limit in this manner the firing range thereof. However, in the range of normal combat conditions and distances the projectile attains a less decelerated, flatter and less elongated flight path which can be easily adjusted to combat conditions.

The projectile of the invention is very simple to construct because the tail section can be made out of a simple turned metal work piece or a pressed metal work piece and it can either be made of unitary construction with the projectile or can be threaded onto the tail portion of the projectile.

BRIEF DESCRIPTION OF THE DRAWING

Although such novel features which are believed to be characteristic of the invention are pointed out in the claims, the invention may be further understood by reference to the description following and the accompanying drawing, wherein:

DETAILED DESCRIPTION OF THE DRAWING

Figure 1:
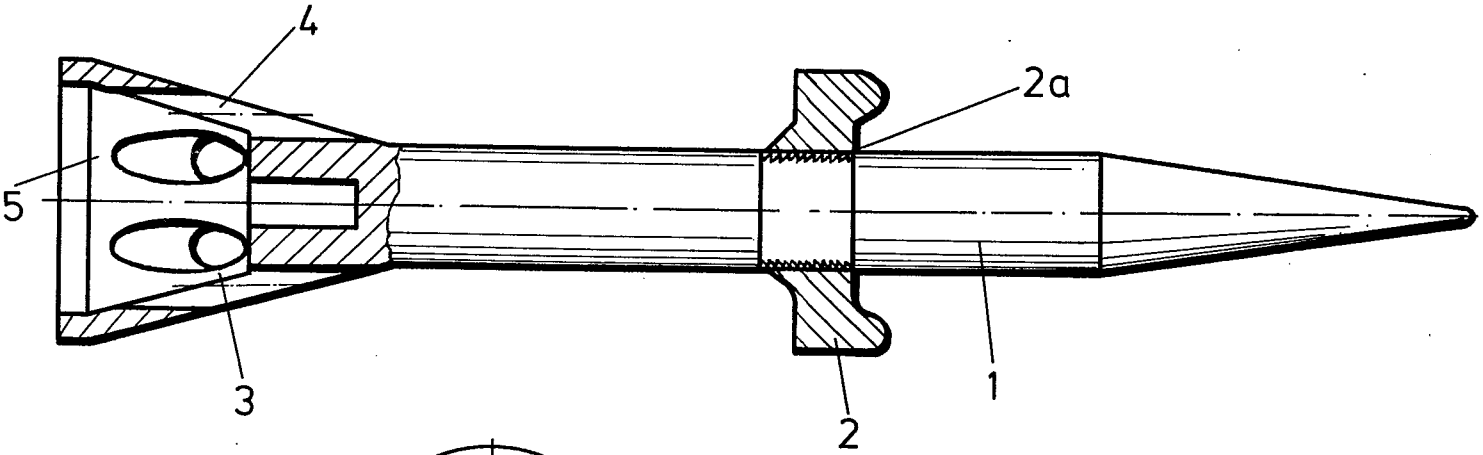
FIG. 1 is a side elevational view, partially in cross-section of an arrow-shaped projectile of this invention.
Figure 2:
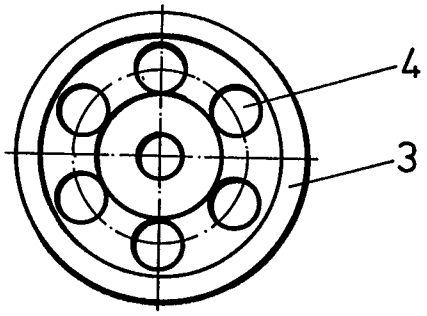
FIG. 2 is a rear view of the projectile of FIG. 1.

As can be noted from FIG. 1 the sub-caliber arrow-shaped projectile has a columnar main body 1 of relatively extended length compared to its diameter. The projectile is provided in its middle region with a drive cage or sabot 2 which is rigidly connected to the main body 1 of the projectile by means of a toothed internal section 2*a* that engages a mating toothed section of the main body 1 of the projectile (see for example U.S. Pat. No. 3,620,167). This projectile is accelerated by means of the dynamic pressure exerted by the powder gas after firing. The drive cage or sabot 2 separates from the main body 1 of the projectile shortly after the projectile has left the barrel of the weapon from which it is fired. The rear of the projectile is provided with a conically shaped tail section 3 which has the maximum exterior diameter that corresponds to the diameter of drive cage or sabot 2 and therefore also corresponds to the caliber of the barrel of the weapon from which the projectile is adapted to be fired. This permits the guidance of the projectile through the barrel of the weapon by means of a very short drive cage 2 and by means of the conically shaped tail section 3.

The conically shaped tail section can also be constructed as a sub-caliber tail section, which then permits and/or requires the utilization of conventional drive cages, as, for example, disclosed in U.S. Pat. No. 3,620,167.

The conically shaped tail section 3 can be made of unitary construction with the main body 1 of the projectile or it can be made as a separable part, for example it can be a turned aluminum work piece and can be screwed onto the tail of the main body 1 of the projectile.

As can be noted from the drawing, the conically shaped tail section 3 is provided with bores 4 that are disposed outside of the diameter of the main body portion 1. Air streams through these bores when the velocity of the projectile during flight is in the higher Mach number range. In the depicted embodiment of FIG. 1 of the projectile there are provided six bores 4 which are equidistantly disposed around the periphery of the tail section 3. The tail section 3 is furthermore provided with a recess 5 the contour of which corresponds substantially to the exterior contour of the conically shaped tail section 3. This recess 5 makes it possible to make the entire tail section 2 very light so that the center of gravity of the entire projectile is situated as forwardly as possible. However, it is within the scope of this invention, to have the entire tail section 3 of solid, non-hollowed-out construction in particular when this tail section is made out of a light material of low specific density.

It is preferred that the arrow-shaped projectile of this invention undergoes reduced spin-stabilization during its flight path. It is therefore possible, and within the scope of this invention, to orient the axes of bores 4 at a predetermined angle relative to the main axis of the projectile. The frictional forces effected by the air streams flowing through the bores 4 will then include a component in the peripheral direction of the projectile which will produce the desired spin or twist. It is furthermore within the scope of the invention to incline the bores relative to the main axis of the projectile so that their axes intersect in front or behind the conically shaped tail section 3 of the projectile. Such an arrangement makes possible a manufacturing simplification which can lead, that means it gives the possibility, to predetermine the effect of the traversing air stream characteristics through the bores 4. For purposes of influencing the resistance increase of the conically shaped tail section in the region of the lower Mach numbers, that is to increase it at a particularly rapid rate, the bores 4 can furthermore, be made convergent-divergent so that they have the characteristics of a supersonic diffuser. The air stream flow conditions that result from such a tail section are described in detail in German Published Pat. No. 2,454,584.

Figure 3:
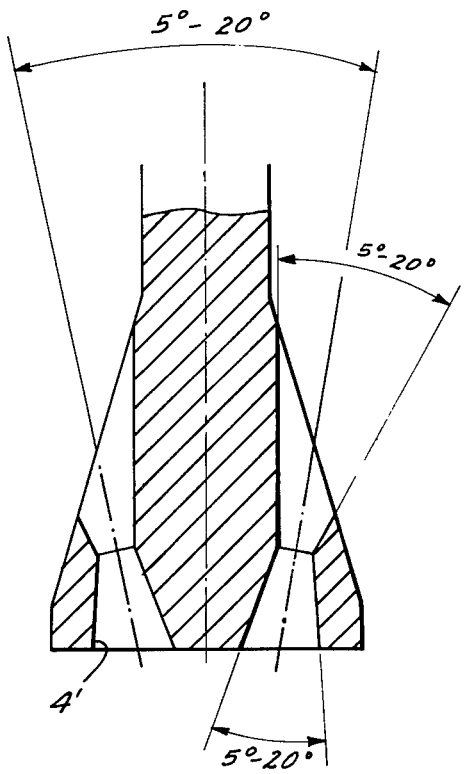
FIG. 3 is a partial side elevational view of an alternate form of a tail section of an arrow-shaped projectile of this invention.

FIG. 3 depicts a tail section 3' having convergent-divergent bores 4' the axes between an oppositely disposed pair of which encompass an angle to 5°–20° which is centered on the longitudinal axis of the projectile. Tests have determined that projectiles having bores with angles of the aforedescribed type which fall outside of this angular range do not give satisfactory results.

Wind tunnel tests have also determined that the wind resistance begins to increase at Mach 2.5 and reaches its maximum at Mach 1.2.

The 5°–20° angle range has also been found to be applicable to projectiles having straight bores inclined to the main axis of the projectile.

As can be noted from FIG. 3 the tail section 3' is not hollowed out as is the tail section 3 of FIG. 1.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An improved sub-caliber projectile having a columnar main body and a resistance-stabilizing tail section operatively connected thereto of larger outside diameter than the diameter of the main body, said projectile being of limited range, wherein said tail section includes at least two bores for the passage of air therethrough for decreasing the resistance with increasing supersonic velocity during flight of the projectile and is rigidly secured to said projectile.

2. The improved sub-caliber projectile as set forth in claim 1, wherein said columnar main body of the projectile has a longitudinal axis, the axes of said bores being parallel to said longitudinal axis.

3. The improved sub-caliber projectile as set forth in claim 1, wherein said columnar main body of the projectile has a longitudinal axis, the axes of said bores are inclined relative to said longitudinal axis.

4. The improved sub-caliber projectile as set forth in claim 3, wherein said bores are convergently-divergently oriented and act as a supersonic diffusor during at least a portion of the flight of the projectile.

5. The improved sub-caliber projectile as set forth in claim 4, wherein said tail section is of frusto-conical shape and has a maximum diameter which corresponds to the caliber of the projectile.

6. The improved sub-caliber projectile as set forth in claim 5, wherein said tail section has a frusto-conically shaped recess which has a contour which corresponds to the exterior contour of the tail section.

7. The improved sub-caliber projectile as set forth in claim 3, wherein the bores are symmetrically disposed about the longitudinal axis of the projectile, their angles of inclination with respect to said longitudinal axis being 2.5°–10°.

8. The improved sub-caliber projectile as set forth in claim 4, wherein the bores are symmetrically disposed about the longitudinal axis of the projectile, their angles of inclination with respect to said longitudinal axis being 2.5°–10°.

* * * * *